US006906580B2

(12) United States Patent
Baskett

(10) Patent No.: US 6,906,580 B2
(45) Date of Patent: Jun. 14, 2005

(54) METHOD OF FORMING A REFERENCE VOLTAGE GENERATOR AND STRUCTURE THEREFOR

(75) Inventor: Ira E. Baskett, Tempe, AZ (US)

(73) Assignee: Semiconductor Components Industries, LLC, Phoenix, AZ (US)

( * ) Notice: Subject to any disclaimer, the term of this patent is extended or adjusted under 35 U.S.C. 154(b) by 0 days.

(21) Appl. No.: 10/464,100

(22) Filed: Jun. 19, 2003

(65) Prior Publication Data

US 2004/0257149 A1 Dec. 23, 2004

(51) Int. Cl.[7] ..... G05F 1/10; G05F 3/02
(52) U.S. Cl. ..... 327/538; 327/543
(58) Field of Search ..... 327/538, 540–541, 327/543, 512, 513; 323/312, 315–316

(56) References Cited

U.S. PATENT DOCUMENTS 3,617,859 A 11/1971 Dobkin ..... 323/313
6,218,894 B1 * 4/2001 De Langen et al. ..... 327/540

FOREIGN PATENT DOCUMENTS

DE 2642874 A * 3/1977 ..... G05F/1/56

* cited by examiner

*Primary Examiner*—Quan Tra
(74) *Attorney, Agent, or Firm*—Robert F. Hightower

(57) ABSTRACT

A reference voltage generator (10) is formed to include a bipolar current mirror the forms an output current (24) that is a function of a Vbe voltage of a reference transistor (14) and the difference between the Vbe voltage of the reference transistor (14) and a difference transistor (19).

10 Claims, 3 Drawing Sheets

10

METHOD OF FORMING A REFERENCE VOLTAGE GENERATOR AND STRUCTURE THEREFOR

BACKGROUND OF THE INVENTION

The present invention relates, in general, to electronics, and more particularly, to methods of forming semiconductor devices and structure.

In the past, the semiconductor industry utilized various methods and structures to produce voltage reference circuits. As semiconductor technology continues to advance, there is a trend to lower and lower supply voltages and reference voltages in all circuit technologies. The lower supply voltages made it difficult for prior reference voltage circuits to provide the desired low reference voltage values. One example of such a voltage reference circuit was disclosed in U.S. Pat. No. 3,617,859 issued to Dobkin et al on Nov. 2, 1971, which is hereby incorporated herein by reference. As illustrated by the Dobkin et al patent, prior reference voltage circuits generally required several levels of base-emitter (Vbe) voltage drops in order to produce the desired reference voltage value. The large number of Vbe voltage drops made it difficult to produce the desired low reference voltage value from the low supply voltage. Additionally, the prior reference voltage circuits required numerous transistors and resistors to generate the reference voltage and to provide temperature compensation. These additional components added additional cost and process sensitivities.

Accordingly, it is desirable to have a reference voltage generator that operates at low supply voltages, that forms a low reference voltage value, that reduces the number of components, and that has a lower manufacturing cost.

For simplicity and clarity of illustration, elements in the figures are not necessarily to scale, and the same reference numbers in different figures denote the same elements. Additionally, descriptions and details of well known steps and elements are omitted for simplicity of the description. As used herein current carrying electrode means an element of a device that carries current through the device such as a source or a drain of an MOS transistor or an emitter or a collector of a bipolar transistor, and a control electrode means an element of the device that controls current through the device such as a gate of an MOS transistor or a base of a bipolar transistor. Although the devices are explained herein as NPN devices, a person of ordinary skill in the art will appreciate that PNP devices are also possible in accordance with the present invention.

DETAILED DESCRIPTION OF THE DRAWINGS

Figure 1:
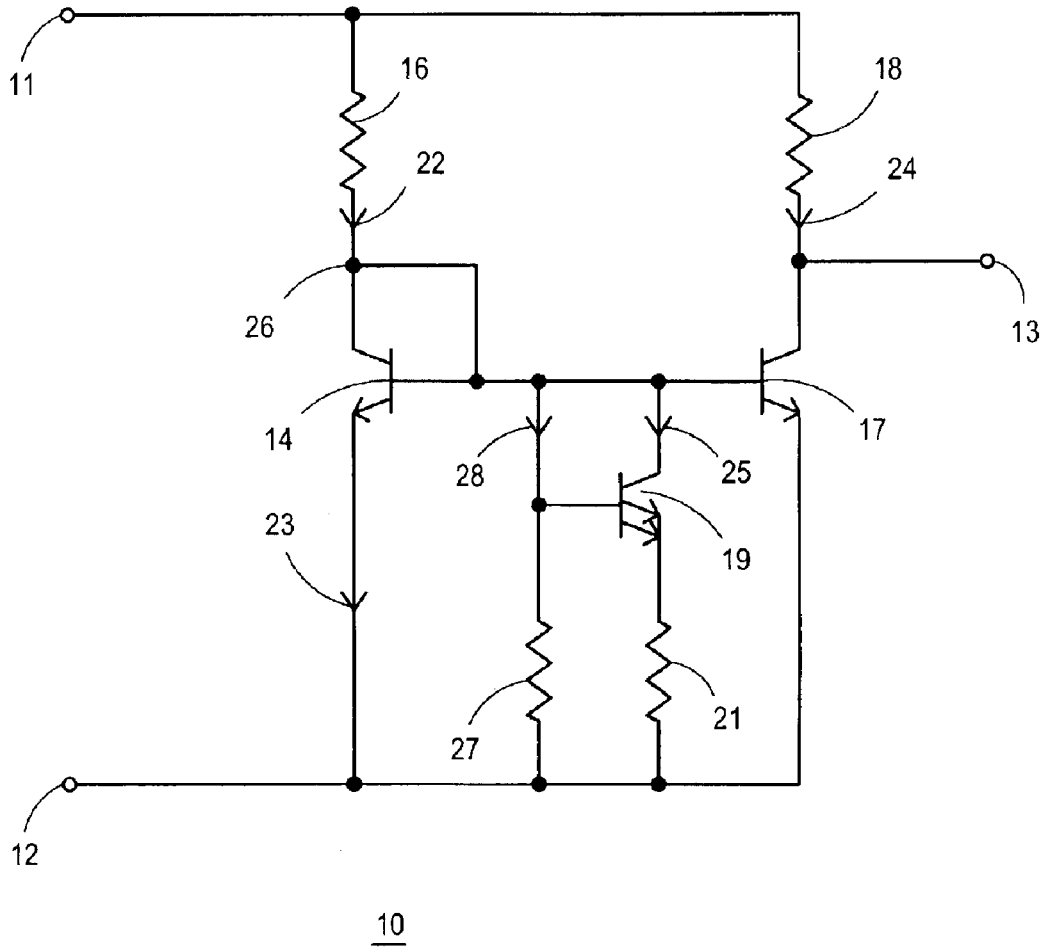
FIG. 1 schematically illustrates a portion of an embodiment of a reference voltage generator in accordance with the present invention.

FIG. 1 schematically illustrates a portion of an embodiment of a bias generator or reference voltage generator 10 that operates at low supply voltages. Generator 10 utilizes a bipolar transistor current mirror that does not have stacked transistors, thus, the supply voltage only has to be slightly greater than one Vbe voltage drop. The current mirror of generator 10 includes a first transistor or reference transistor 14, a second transistor or difference transistor 19, a third transistor or mirror transistor 17, a reference resistor 16, a Vbe resistor 27, a Delta Vbe resistor 21, and a mirror resistor 18. As will be seen in the description hereinafter, the current mirror is formed to generate an output current that is a function of the Vbe voltage of transistor 14 plus the difference between the Vbe voltages of transistors 14 and 19 or Delta Vbe voltage. Since the Vbe voltage decreases with temperature and the Delta Vbe voltage increases with temperature, facilitates forming the output current and thus the output voltage to be substantially constant over temperature. It also allows forming the output current and output voltage to have a controlled variation over temperature. Generator 10 receives a supply voltage or input voltage between a voltage input 11 and a voltage return 12, and generates the reference voltage on a reference voltage output 13.

In operation, the Vbe voltage of transistor 14 is reflected to a Vbe node 26. This voltage forces a reference current 22 (I22), illustrated by an arrow, to flow through resistor 16. Reference current 22 (I22) is equal to the value of the input voltage (VI) minus the Vbe voltage of transistor 14 (Vbe14) divided by the value of resistor 16 (R16) as shown below:

$$I22=((VI-(Vbe14))/R16).$$

A first portion of reference current 22 flows through transistor 19 as a difference current 25, a second portion of reference current 22 flows through transistor 14 as a reminder current 23, and a third portion flows through resistor 27 as a Vbe current 28. The voltage across resistor 27 is the Vbe voltage of transistor 14, thus current 28 is the Vbe voltage divided by the value of resistor 27 ((Vbe14)/(R27)). Currents 25, 23, and 28 are illustrated in FIG. 1 by arrows. Transistor 19 is formed to have a larger area than the area of transistor 14 so that the Vbe voltage of transistor 19 is less than the Vbe voltage of transistor 14. Typically transistor 19 is eight to ten times larger that transistor 14. The larger area of transistor 19 is indicated by multiple emitter symbols for transistor 19. Because the Vbe voltage of transistor 19 is less than the Vbe voltage of transistor 14, the voltage drop across resistor 21 is the difference between the two Vbe voltages or Delta Vbe. Thus the value of difference current 25 (I25) is Delta Vbe divided by the value of resistor 21 (R21) as shown below:

$$I25=((\text{Delta } Vbe)/R21).$$

The value of remainder current 23 is the value of reference current 22 minus difference current 25 and minus Vbe current 28 or:

$$I23=I22-I25-I28,$$

Substituting I22, I25, and I28 from above yields;

$$I23=((VI-(Vbe14))/R16)-((Vbe)/(R27))-((\text{Delta } Vbe)/R21).$$

The value of the reference voltage (Vref) on output 13 is equal to the value of the input voltage (VI) minus the value of resistor 18 times output current 24. Transistor 17 is matched to transistor 14 so the current mirror configuration forces the Vbe voltage of transistor 17 to equal the Vbe voltage of transistor 14 and also forces the value of output current 24 to be equal to the value of remainder current 23 that flows through transistor 14. As shown by the previous equation for I23, the value of remainder current 23 is a function of the Vbe voltage of transistor 14 minus Delta VB, consequently output current 24 and the output voltage is also a function of both Vbe and Delta Vbe as shown below:

$$Vref=VI-(R18)(I24).$$

Substituting I24=I23 and the value of I23 yields;

$$Vref = VI - (R18)(((VI - (Vbe14))/R16) - ((Vbe)/(R27)) - ((Delta\ Vbe)/R21)).$$

Since $R18 = R16$, $$Vref = VI - (R16)(((VI - (Vbe14))/R16) - ((Vbe)/(R27)) - ((Delta\ Vbe)/R21)),$$

$$= VI - VI + (Vbe14) + ((Vbe14)(R16/R27)) + (Delta\ Vbe)(R16/R21),$$

$$= (Vbe14) + ((Vbe14)(R16/R27)) + (Delta\ Vbe)(R16/R21).$$

Where:

R16=Value of resistor 16,

R18=Value of resistor 18,

R21=Value of resistor 21,

R27=Value of resistor 27, (Vbe14)=Vbe voltage of transistor 14 which also equals the Vbe voltage of transistor 17, Delta Vbe=Vbe voltage of transistor 19 minus (Vbe14), VI=Input voltage between input 11 and return 12, and Vref=Reference voltage on output 13.

As the temperature increases or decreases, generator 10 keeps the value of current 24 approximately constant in order to keep the value of the reference voltage approximately constant. For example, as the temperature increases the value of the Vbe voltage of transistors 14 and 19 decreases but the Vbe voltage of transistor 19 decreases faster than the Vbe voltage of transistor 14. Therefore, Delta Vbe increases and the value of difference current 25 must increase in order to increase the voltage drop across resistor 21. The decrease in the Vbe voltage of transistor 14 causes a corresponding decrease in the voltage at node 26, thus reference current 22 increases to corresponding increase the voltage drop across resistor 16. Typically the decrease in the voltage at node 26 is very small compared to the value of the voltage across resistor 16 so the increase in current 22 is very small. For example if the input voltage is about two volts (2.0 V) and Vbe is about 0.75 volts, the voltage across resistor 16 would be about 1.25 volts. The decrease in Vbe due to a temperature change from twenty-five degrees Celsius to seventy-five degrees Celsius generally is no greater than about twenty milli-volts (0.020 volts). Thus the corresponding change in current 22 to account for the twenty milli-volt Vbe change would only be about one to two percent (1%–2%) of the value of current 22. The decrease in the value of the Vbe voltage of transistor 14 also causes a decrease in the value of Vbe current 28. As can be seen, current 28 decreases with temperature while current 25 increases. Summing currents 25 and 28 at node 26 facilitates forming generator 10 to maintain the value of current 23 substantially constant over the temperature range or to alternately to control current 23 to vary at a desired rate of change over the temperature range. IN the preferred embodiment, the values of resistors 16, 27, and 21 and the area of transistor 19 are chosen to ensure that the increase in the value of current 22 is approximately equal to the increase in current 25 minus the decrease in current 28 so that the value of current 23 does not change. If the value of current 23 does not change then the value of current 24 also does not change thus the value of the reference voltage also does not change. Typically, the value of the reference voltage varies less than about one to two percent (1% to 2%) for a temperature change from about twenty-five degrees Celsius to about seventy-five degrees Celsius (25° C. to 75° C.). It should be noted that in other embodiments, the values of resistors 16, 27, and 21 and the area of transistor 19 may be chosen to vary the reference voltage over temperature to at some other desired rate of change. For a decrease in temperature the changes occur in the opposite direction.

In one example embodiment, the input voltage is about 1.8 volts, resistors 16 and 18 have a value of about two thousand four hundred (2400) ohms, resistor 21 has a value of about eight hundred to twelve hundred (800–1200) ohms, resistor 27 has a value in the range of about ten thousand ohms (10K ohms), and transistor 19 has an area that is about ten (10) times of the area of transistor 14. The resulting reference voltage is nominally about one volt (1 V). As the temperature varies from about twenty-five degrees Celsius to seventy-five degrees Celsius (25° C. to 75° C.), the value of the reference voltage varies less than about one to two percent (1%–2%).

In order to facilitate this operation, transistor 14 has an emitter connected to return 12, and a base connected to a collector of transistor 14, to a first terminal of resistor 16, and to a first terminal of resistor 27. A second terminal of resistor 16 is connected to input 11, and a second terminal of resistor 27 is connected to return 12. A base of transistor 19 is connected to a collector of transistor 19 and to the base of transistor 14. An emitter of transistor 19 is connected to a first terminal of resistor 21 while a second terminal of resistor 21 is connected to return 12. Transistor 17 has a base connected to the base of transistor 14, an emitter connected to return 12, and a collector connected to output 13. A first terminal of resistor 18 is connected to output 13, and a second terminal is connected to input 11.

Figure 2:
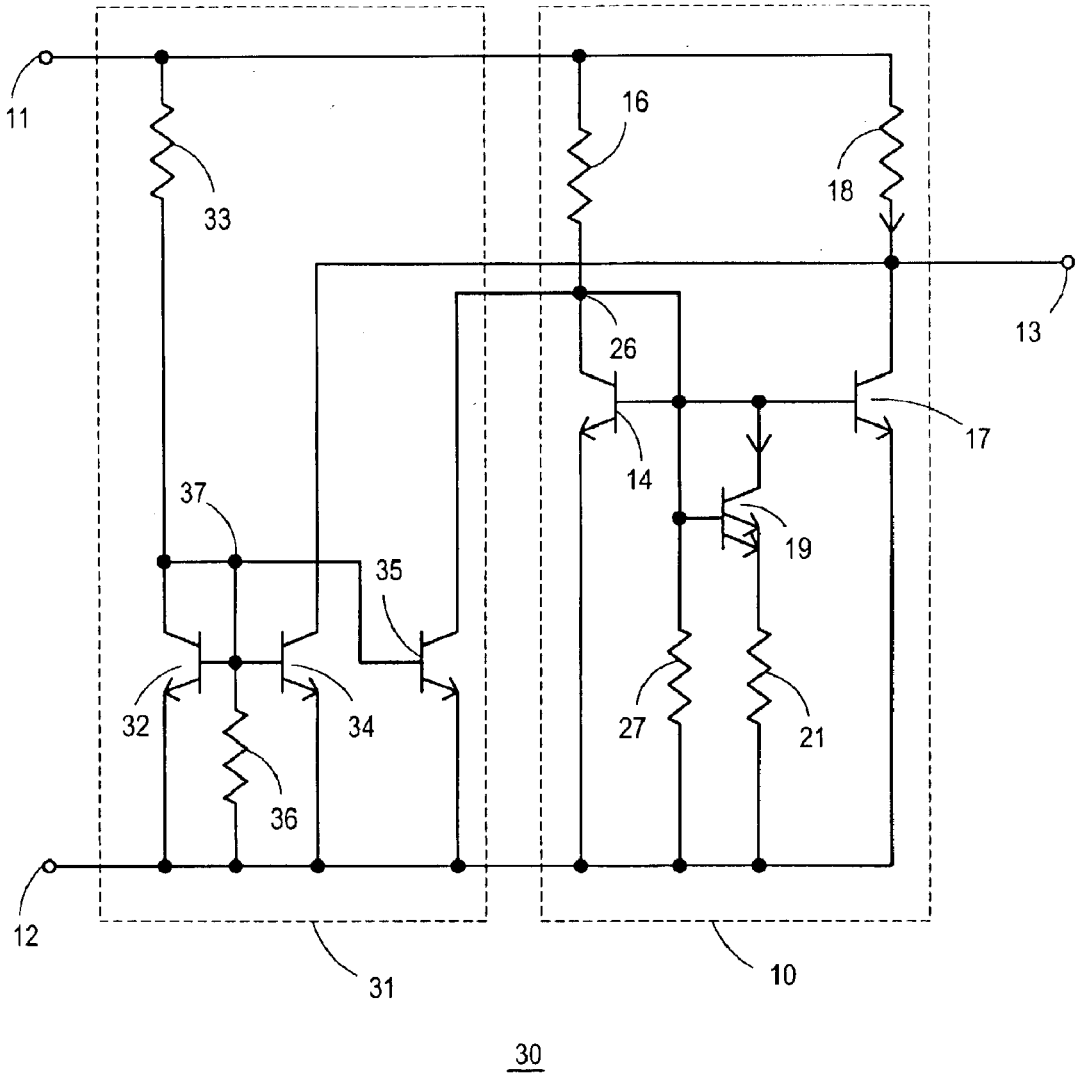
FIG. 2 schematically illustrates a portion of an embodiment of another reference voltage generator in accordance with the present invention.

FIG. 2 schematically illustrates an embodiment of a bias generator or reference voltage generator 30 that is an alternate embodiment of generator 10 explained in the description of FIG. 1. Generator 30 includes generator 10 plus a pre-regulator 31 that assists in keeping the value of the output voltage at output 13 constant for large changes in the value of the input voltage. Regulator 31 includes a bipolar current mirror that has a regulator transistor 32, a first output transistor 34, a second output transistor 35, a resistor 33, and a resistor 36. Transistors 32, 34, and 35 typically are matched. As the value of the input voltage changes, the value of the Vbe voltage of transistor 32 maintains the value of the voltage at a regulator node 37 relatively constant. Through the current mirror configuration, the value of the collector voltage of transistors 34 and 35 only varies about eighteen milli-volts (18 mV) for each doubling of the voltage across resistor 33. Thus, as the value of the input voltage increases or decreases, transistors 34 and 35 limit the change in the value of the voltage at output 13 and node 26.

In order to facilitate this operation, transistor 32 has a base and a collector connected to a first terminal of resistor 33 and to a first terminal of resistor 36, and an emitter connected to return 12. A second terminal of resistor 33 is connected to input 11 and a second terminal of resistor 33 is connected to return 12. Transistor 34 has an emitter connected to return 12, a collector connected to output 13, and a base connected to the base of transistor 32. An emitter of transistor 35 is connected to return 12, a base is connected to the base of transistor 32, and the collector is connected to node 26.

Figure 3:
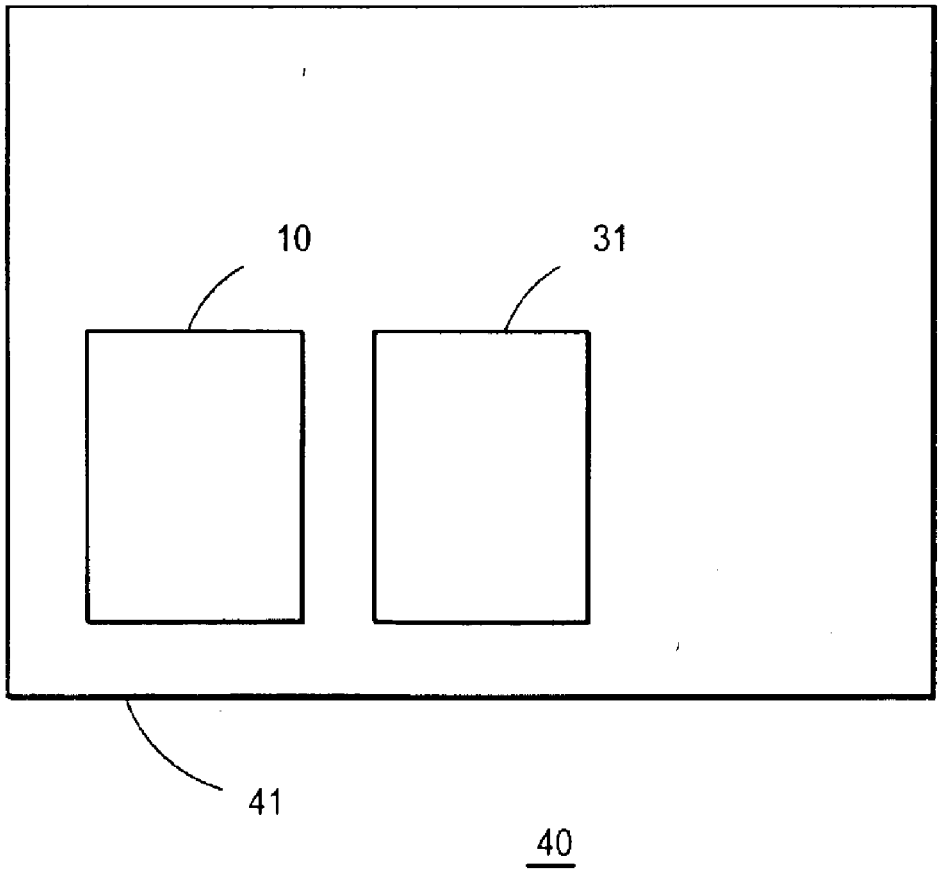
FIG. 3 schematically illustrates an enlarged plan view of a semiconductor device that includes the reference voltage generators of FIG. 1 and FIG. 2 in accordance with the present invention.

FIG. 3 schematically illustrates an enlarged plan view of a portion of an embodiment of a semiconductor device 40 that is formed on a semiconductor die 41. Generator 10 is formed on die 41. In some embodiments, pre-regulator 31 may also be formed on die 41. Die 41 may also include other circuits that are not shown in FIG. 3 for simplicity of the drawing.

In view of all of the above, it is evident that a novel device and method is disclosed. Included, among other features, is forming a reference voltage generator that has an output current that is a function of a Vbe voltage and a Delta Vbe voltage. The relationship facilitates forming the generator to be devoid of stacked Vbe voltages and facilitates operation at low power supply voltages. Forming the output transistor and the difference transistor as part of the current mirror facilitates good temperature compensation without having other components external to the mirror. This also lowers the cost as well as improving the performance.

While the invention is described with specific preferred embodiments, it is evident that many alternatives and variations will be apparent to those skilled in the semiconductor arts. More specifically the invention has been described for a particular NPN transistor structure, although the method is directly applicable to other bipolar transistors including PNP transistors and IIL transistors.

What is claimed is:

1. A method of forming a reference voltage generator comprising:

forming a bipolar transistor current mirror to generate an output current that is a function of both a value of a first Vbe voltage of a reference transistor of the bipolar transistor current mirror plus a value of a difference between the value of the first Vbe voltage and a value of a second Vbe voltage of a difference transistor of the bipolar transistor current mirror including coupling the reference transistor and the difference transistor to generate a reference current proportional to the first Vbe voltage of the reference transistor, coupling the difference transistor to receive a first portion of the reference current as a difference current, coupling the reference transistor to receive a second portion of the reference current as a remainder current, and coupling a Vbe resistor to the reference transistor and the difference transistor to receive the first Vbe voltage and responsively form a Vbe current to flow through the Vbe resistor as a third portion of the reference current.

2. The method of claim 1 wherein coupling the reference transistor and the difference transistor to generate the reference current includes coupling a reference resistor to the reference transistor and the difference transistor to form the reference current to flow through the reference resistor.

3. The method of claim 1 wherein coupling the difference transistor to receive the first portion of the reference current as the difference current includes forming the difference transistor to generate the difference current as a function of the difference between the value of the first Vbe voltage and the value of the second Vbe voltage of the difference transistor.

4. The method of claim 3 further including forming the difference transistor to generate the second Vbe voltage less than the first Vbe voltage.

5. The method of claim 3 wherein forming the difference transistor to generate the difference current as the function of the difference between the value of the first Vbe voltage and the value of the second Vbe voltage of the difference transistor includes coupling a difference resistor to receive the difference current from the difference transistor.

6. The method of claim 1 further including forming a mirror transistor of the bipolar transistor current mirror to receive the first Vbe voltage of the reference transistor and responsively generate a third Vbe voltage having the value of the first Vbe voltage and responsively generate the output current equal to the remainder current.

7. The method of claim 6 further including coupling a mirror resistor to the mirror transistor so that the output current flow is through the mirror resistor and the mirror transistor.

8. A reference voltage generator structure comprising:

a first transistor having a first current carrying electrode coupled to a control electrode, and a second current carrying electrode connected to a voltage return;

a first resistor having a first terminal coupled to the first current carrying electrode of the first transistor, and a second terminal coupled to a voltage input;

a second transistor having a control electrode connected to the control electrode of the first transistor and to a first current carrying electrode, and a second current carrying electrode;

a second resistor having a first terminal connected to the second current carrying electrode of the second transistor, and a second terminal connected to the voltage return;

a third transistor having a control electrode connected to the control electrode of the first transistor, a first current carrying electrode connected to the voltage return, and a second current carrying electrode connected to a voltage output; and a third resistor having a first terminal connected to the voltage output, and a second terminal connected to the voltage input.

9. The reference voltage generator structure of claim 8 further including a fourth transistor having a first current carrying electrode coupled to a control electrode, and a second current carrying electrode connected to the voltage return; a fourth resistor having a first terminal connected to the first current carrying electrode of the fourth transistor, and a second terminal connected to the voltage input; a fifth transistor having a first current carrying electrode connected to the voltage return, a control electrode connected to the control electrode of the fourth transistor, and a second current carrying electrode coupled to the voltage output; a fifth resistor having a first terminal connected to the control electrode of the fourth transistor, and a second terminal connected to the voltage return; and a sixth transistor having a control electrode connected to the control electrode of the fourth transistor, a first current carrying electrode connected to the voltage return, and a second current carrying electrode contend to the first current carrying electrode of the first transistor.

10. The reference voltage generator structure of claim 8 further including a sixth resistor having a first terminal connected to the control electrode of the first transistor and a second terminal connected to the voltage return.

* * * * *